US006629713B1

(12) United States Patent
Duffy et al.

(10) Patent No.: US 6,629,713 B1
(45) Date of Patent: Oct. 7, 2003

(54) DEAD BOLT LOCK ASSEMBLY FOR SLIDING DOORS AND/OR WINDOWS

(76) Inventors: Edward J. Duffy, 179 Sandpond Rd., Warwick, RI (US) 02888; Leo J. Dahlgren, 136 Custer St., Apt. A, Warwick, RI (US) 02889

( * ) Notice: Subject to any disclaimer, the term of this patent is extended or adjusted under 35 U.S.C. 154(b) by 0 days.

(21) Appl. No.: 10/015,210

(22) Filed: Nov. 20, 2001

(51) Int. Cl.[7] ..... E05B 63/20
(52) U.S. Cl. ..... 292/332; 292/335
(58) Field of Search ..... 292/332, 335, 292/341.15; 70/142

(56) References Cited

U.S. PATENT DOCUMENTS

| | | | | | |
|---|---|---|---|---|---|
| 1,409,245 | A | * | 3/1922 | Segal | |
| 2,672,745 | A | * | 3/1954 | Marchetti | 70/101 |
| 3,731,506 | A | | 5/1973 | Greene et al. | |
| 3,768,847 | A | | 10/1973 | Buck, Jr. et al. | |
| 3,806,176 | A | * | 4/1974 | Massie | 292/150 |
| 4,005,885 | A | | 2/1977 | Austin, Jr. | |
| 4,068,506 | A | | 1/1978 | Phelps | |
| 4,225,004 | A | * | 9/1980 | Lipshield | 180/89.14 |
| 4,239,268 | A | | 12/1980 | Rider | |
| 4,463,005 | A | | 7/1984 | Jones et al. | |
| 4,514,996 | A | | 5/1985 | Sjogren | |
| 4,828,299 | A | * | 5/1989 | Poe | 292/139 |
| 5,104,163 | A | * | 4/1992 | Palmer, Jr. et al. | 292/335 |
| 5,927,769 | A | * | 7/1999 | Pullen | 292/169.13 |
| 6,192,723 | B1 | | 2/2001 | Brownell, Sr. | |

* cited by examiner

*Primary Examiner*—Gary Estremsky
(74) *Attorney, Agent, or Firm*—Salter & Michaelson

(57) ABSTRACT

A dead bolt lock assembly for securing a sliding door or window and including a wall mountable dead bolt lock, and a door mountable dead bolt lock which matingly engage in the locked position to secure the sliding door or window shut, is disclosed. The wall mountable dead bolt lock may be moved between an unlocked position and a locked position (where it is received within the housing of the door mounted dead bolt) in an automatic manner by an actuator which is preferably normally biased to extend slightly beyond the door jamb. The actuator may be connected to the dead bolt by a drive assembly which is activated upon movement of the actuator inwardly toward the door jamb, for example by a plunger. In one embodiment, as the actuator moves inwardly, it causes the dead bolt to move outwardly, until it is received within the housing of the door mounted dead bolt. The wall mounted dead bolt includes an aperture at one end for receiving the dead bolt of the door mounted dead bolt therein. The sliding door is locked when the door mounted dead bolt is moved into the aperture of the wall mounted dead bolt.

16 Claims, 13 Drawing Sheets

DEAD BOLT LOCK ASSEMBLY FOR SLIDING DOORS AND/OR WINDOWS

TECHNICAL FIELD

The invention relates generally to a dead bolt lock for securing sliding doors and/or sliding windows, and, more specifically, to a dead bolt lock having a bolt secured within and extending from a wall in order to lock the door or window in a closed position.

BACKGROUND OF RELATED ART

Sliding doors and windows are popular in many homes as they allow sunlight and warmth into a room, while providing convenient access to the outdoors. However, such doors are also a major entry point for burglars. The most inexpensive prevention device is to place a dowel or piece of wood in the door track. This is most effective if the dowel is cut so the door cannot be opened at all. Many people, however, cut the rood piece about 6 inches short to allow partial opening for ventilation. This allows the burglar to rock the door off its track or even use a device to remove the dowel altogether. Although effective when properly used, a dowel positioned in a door is both unattractive and cumbersome. Attempts to provide sturdy and reliable locking mechanism for sliding door and windows have been attempted with little success. Specifically, prior art locks which are mounted partially to the sliding door or window, and which are secured to the door or window jamb in the locked position have been developed. A popular lock style includes a slidable latch carried by the door which, when activated by the user, hooks into a metal loop carried by the door frame to prevent the door from being slid into its open position. This type of latch is noticeably insecure and can be easily disengaged by force. It is relatively easy for a criminal to break the lock simply by breaking or bending the loop, or by breaking the door jamb. For example, a screwdriver may be inserted between the jamb and the sliding door or window, and the leverage created breaks the lock. In an attempt to cure these deficiencies, several types of locking devices have been proposed, none of which have been particularly effective in securing the sliding doors shut and reducing burglaries.

Accordingly, there is needed in the art a reliable lock for a sliding door which is easy to use, which deters burglars, and which is attractive.

SUMMARY

One object of the present invention is to provide a lock for a sliding door or window which is easy and effective to use, which can be readily installed and which appears attractive in its surroundings.

There is provided herein a dead bolt lock assembly for securing a sliding door or sliding window which includes a wall mountable dead bolt lock and a window or door mountable dead bolt lock, which matingly engage in the locked position in order to secure the sliding door or window shut. The wall mountable dead bolt lock may be moved between an unlocked position and a locked position (where it is received within the housing of the door mounted dead bolt) in an automatic manner by an actuator which is preferably normally biased to extend slightly beyond the door jamb. The actuator may be connected to the dead bolt by a drive assembly which is activated upon movement of the actuator inwardly toward the doorjamb, for example by a plunger. In one embodiment, as the actuator moves inwardly, it causes the dead bolt to move outwardly, until it is received within the housing of the door mounted dead bolt. The wall mounted dead bolt includes an aperture at one end for receiving the dead bolt of the door mounted dead bolt therein. The sliding door is locked when the wall mounted dead bolt is moved along a first axis into the housing of the door mounted dead bolt, and the door mounted dead bolt is moved along an axis substantially perpendicular to the first axis and into the engagement with the aperture of the wall mounted dead bolt.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATION EMBODIMENTS

Figure 1:
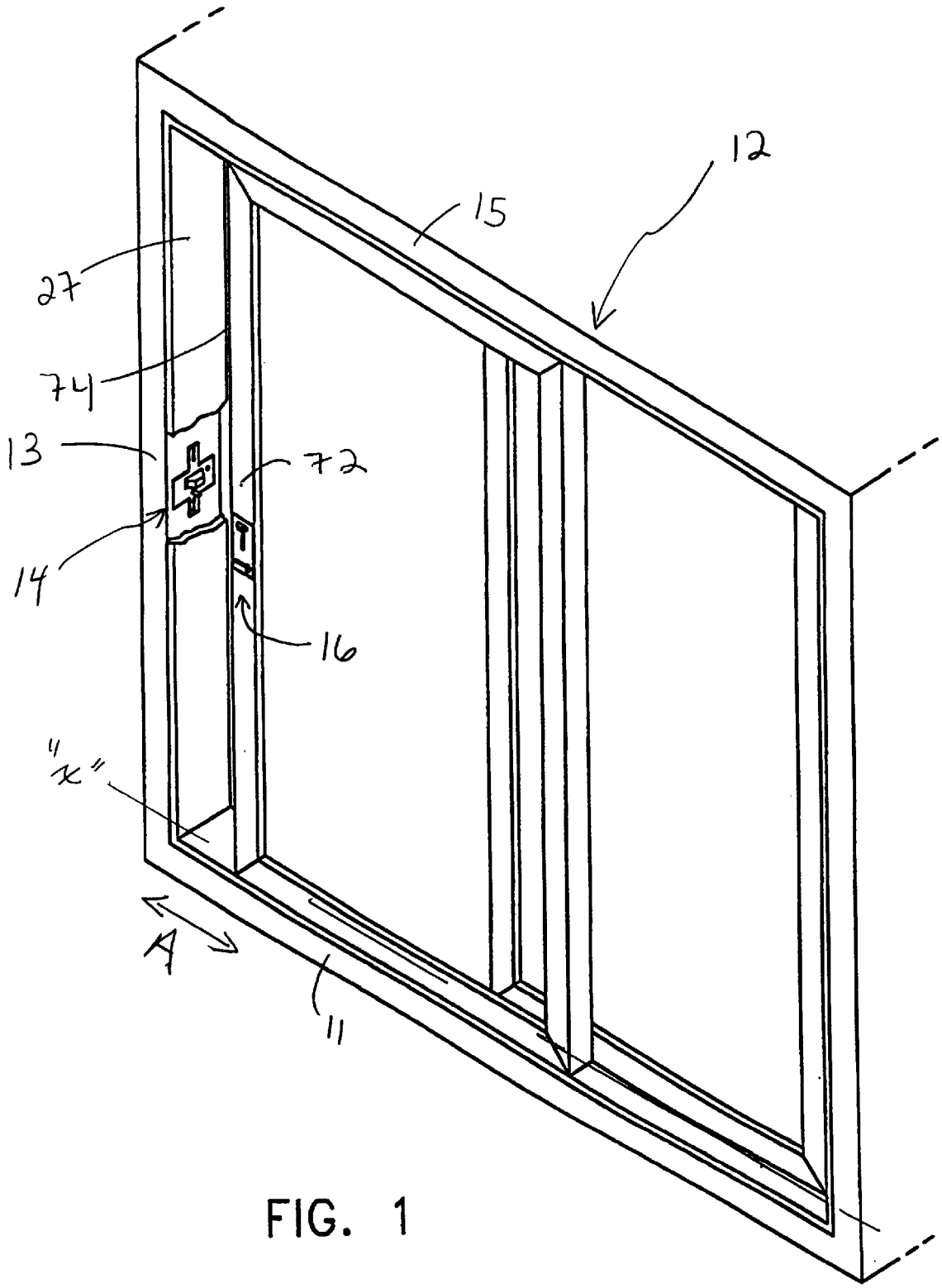
FIG. 1 is a perspective view of a dead bolt lock assembly installed for use with a sliding door or window according to the present invention.
Figure 2:
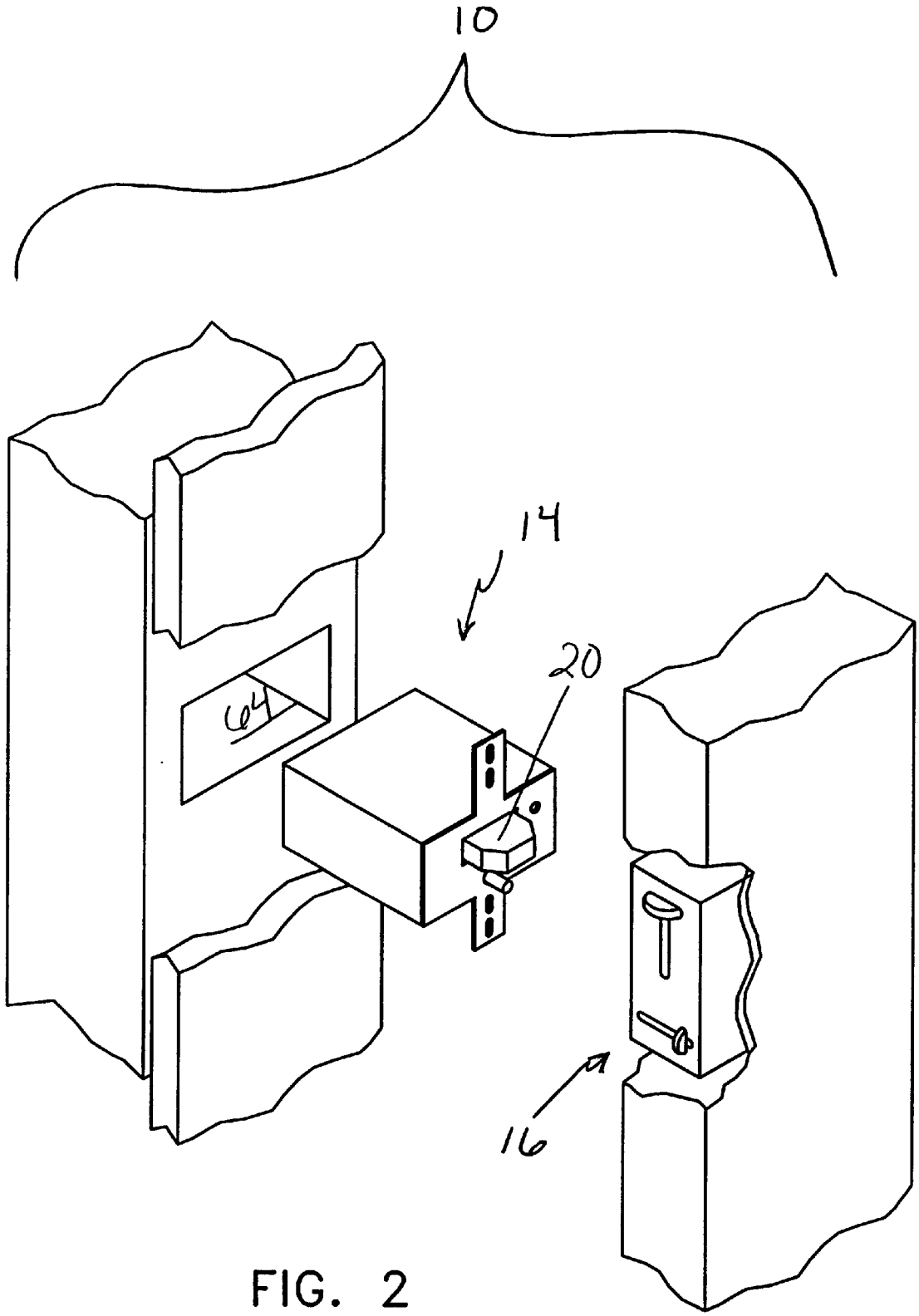
FIG. 2 is an exploded, partially cut away view of the dead bolt lock assembly of FIG. 1.
Figure 3:
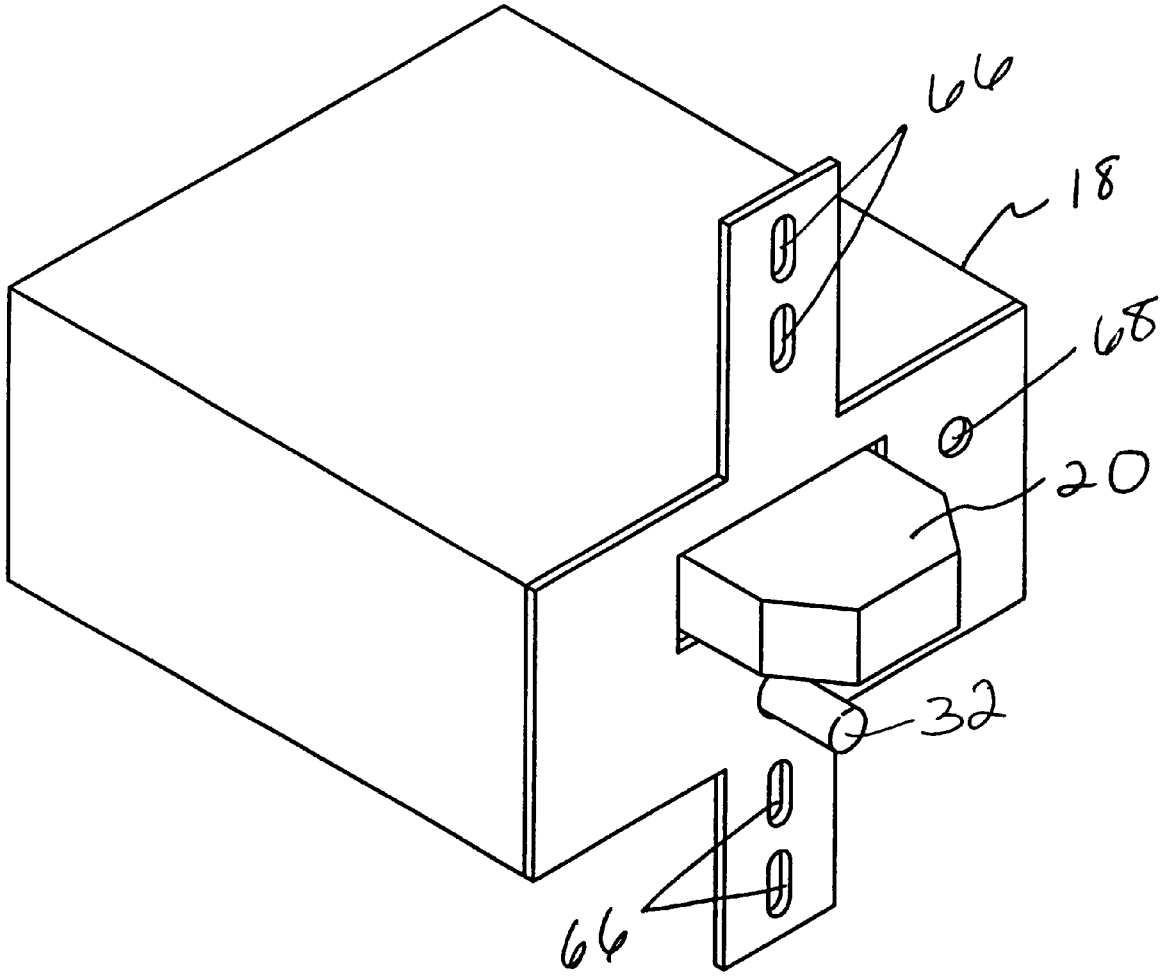
FIG. 3 is a perspective view of the wall mounted dead bolt of FIG. 1.
Figure 4:
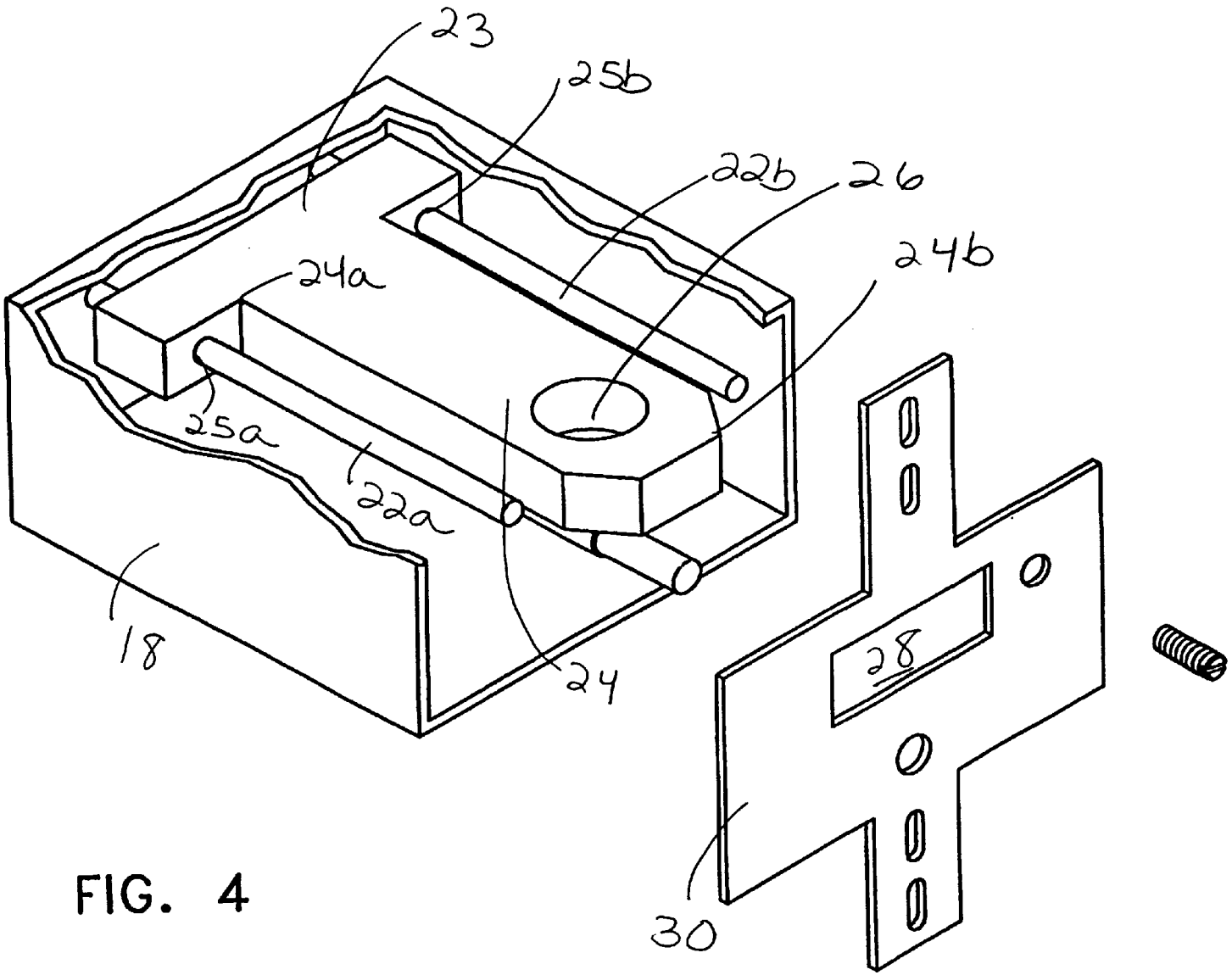
FIG. 4 is a perspective view of the wall mounted dead bolt of FIG. 3 with the face plate removed and a portion of the housing cut away.
Figure 5:
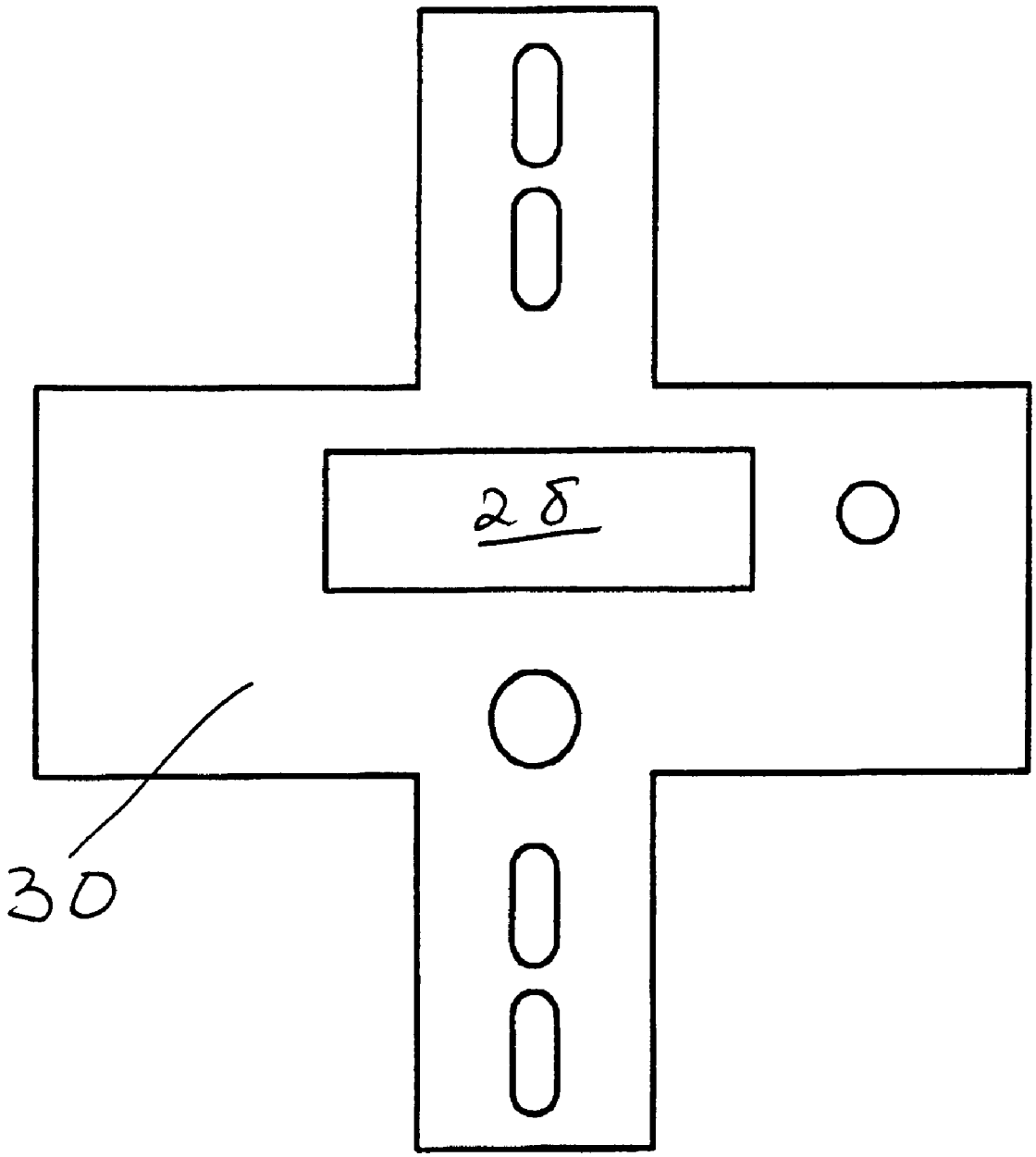
FIG. 5 is a front view of the face plate of the wall mounted dead bolt of FIG. 3.
Figure 6:
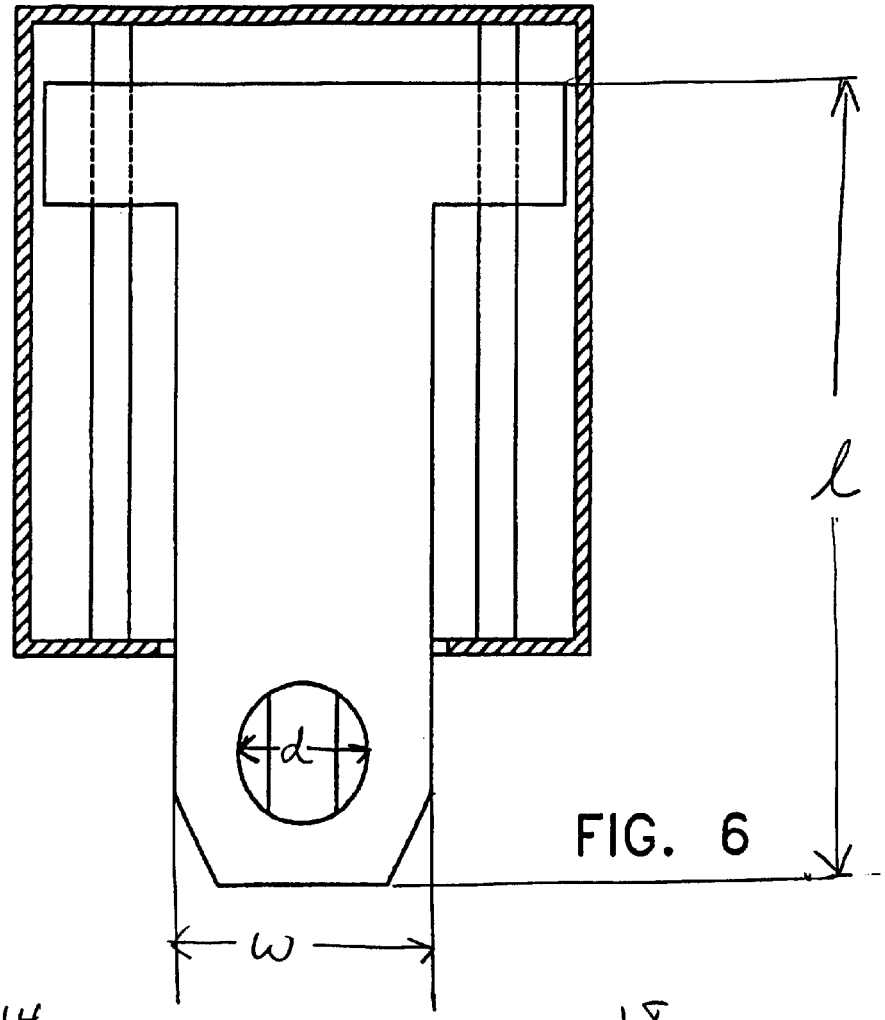
FIG. 6 is a top view of the wall mounted dead bolt of FIG. 3 with the housing in cross section.

A dead bolt lock assembly 10 for use with a sliding door 12 or window is illustrated in FIGS. 1–14. The dead bolt lock assembly 10 includes a wall mountable dead bolt lock 14 and a window or door mountable dead bolt lock 16 which matingly engage in the locked position in order to secure the sliding door or window closed. As used herein, the term "sliding" refers to any door or window which moves sideways, along a first axis "x" which runs substantially parallel to the axis of a sill member 11 or head member 15 (see arrow "A" FIG. 1). As also used herein, the term "door" or "sliding door" refers to any type or style of sliding door where one or more panels are sliding, including, but not limited to sliding glass doors, pocket doors, and the like. The description that follows refers to sliding doors, but it will be appreciated that the dead bolt lock assembly may also be utilized with any other members that slide, such as windows, and is not limited to use with doors.

Figure 14:
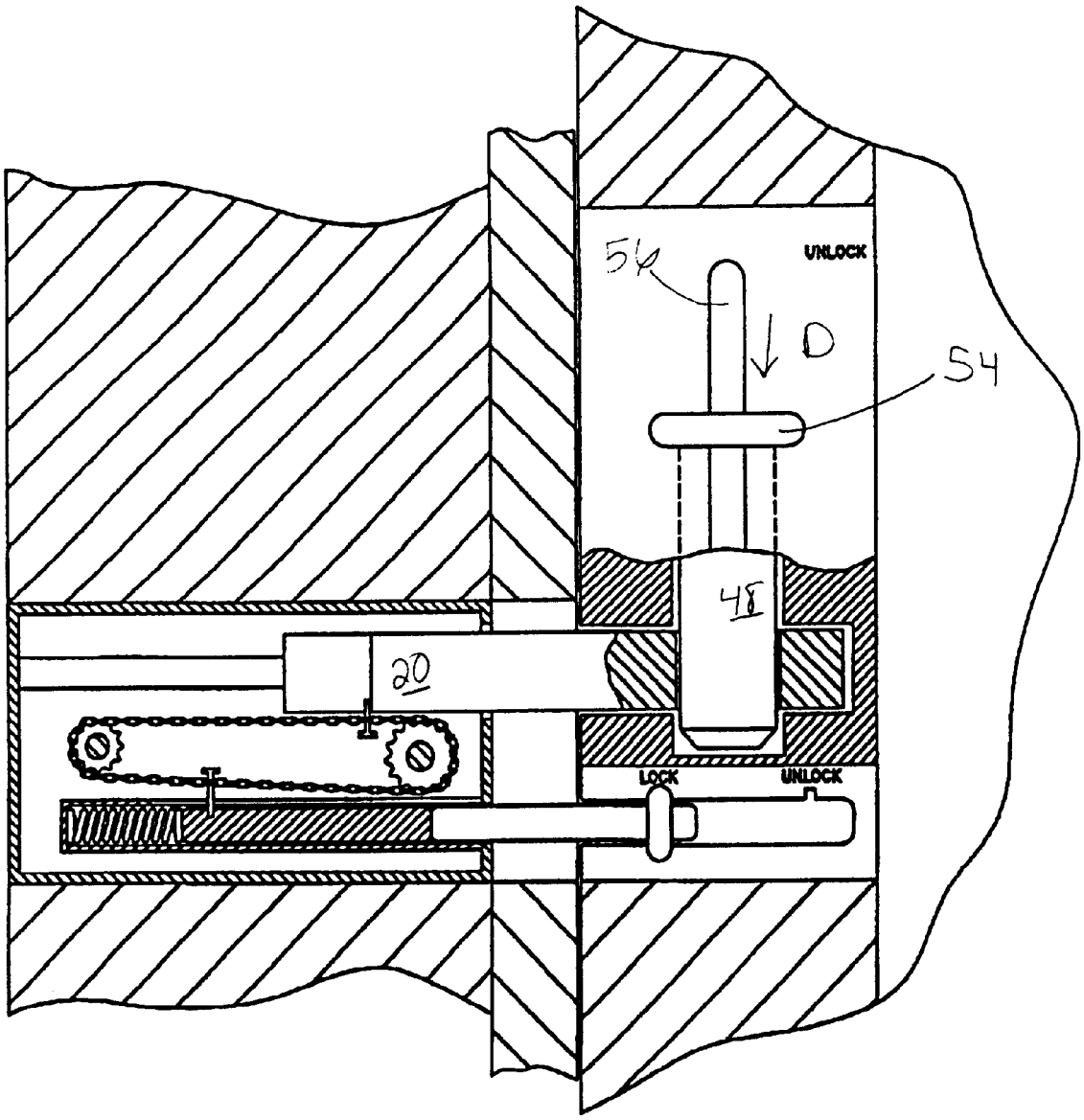
FIG. 14 is a partial cross-sectional view of the dead bolt assembly with both the wall mounted dead bolt and the door mounted dead bolt in the locked position.

The wall mountable dead bolt lock 14 preferably includes a housing 18 for mounting within a wall stud 13 and for supporting dead bolt 20 therein, the dead bolt being movable between an unlocked position (FIG. 11) and a locked position (FIG. 14). In the present embodiment, the bolt 20 is preferably supported within the housing on a pair of guide pins or rods 22*a*, 22*b* (FIG. 4), such that the bolt is slidable upon the rods in order to move the bolt reciprocally between the locked and unlocked positions. The bolt 20 may preferably include a cross piece 23 having a pair of apertures 25*a*, 25*b* for receiving the rods 22*a*, 22*b*, the cross piece 23 also supporting locking piece 24 so as to form a "T-shaped" configuration for the dead bolt 20. The cross piece may further act as a stop when the dead bolt is extended in the locked position by abutting an inner surface of faceplate 30. The locking piece 24 is preferably supported at a first end 24*a* by the cross piece 23, and extends from the cross piece a length sufficient to project from within the wall stud 13 and engage the door mounted dead bolt lock 16 in the locked position. A second end 24*b* of the locking piece 24 includes an aperture 26 which is sized to receive the dead bolt 48 of the door mounted dead bolt lock 16 in the locked position, as described in greater detail herein below. The second end may also preferably have a tapered configuration which allows it to readily fit through both an opening 28 in the housing 18, and a corresponding opening 47 in the housing 46 of the door mounted dead bolt lock 16. In the present embodiment, the opening 28 may be formed within faceplate 30 of the housing 18. The face plate may be utilized to mount the housing 18 within the wall stud 13, as also described in greater detail herein below. The housing 18 and the dead bolt 20 may be made of any suitable material, may have any of a number of shapes, and may also have any suitable dimensions, as would be known to those of skill in the art. In the present embodiment, the dead bolt 20 may be made from steel, and may have a total length, "1", of about 3 inches, a thickness, "τ", of about ¾ of an inch, a width, "w" of about 1.75 inches at the locking piece, and aperture 26 may have a diameter, "d", of about 1.5 inches (See FIG. 6).

Figure 7:
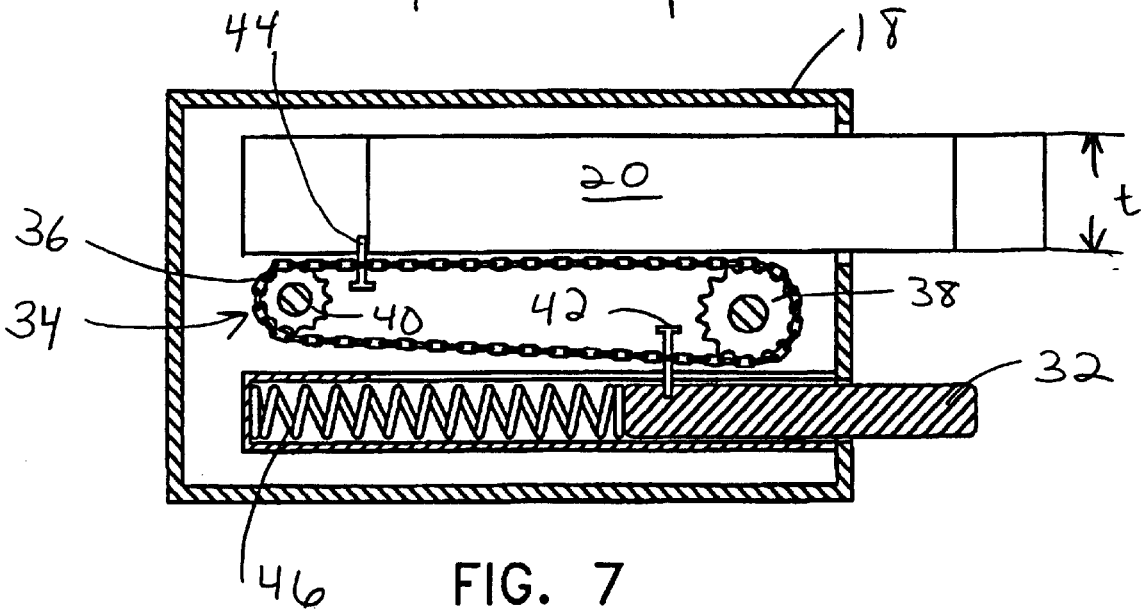
FIG. 7 is a side view in partial cross-section view of the wall mounted dead bolt of FIG. 3.
Figure 11:
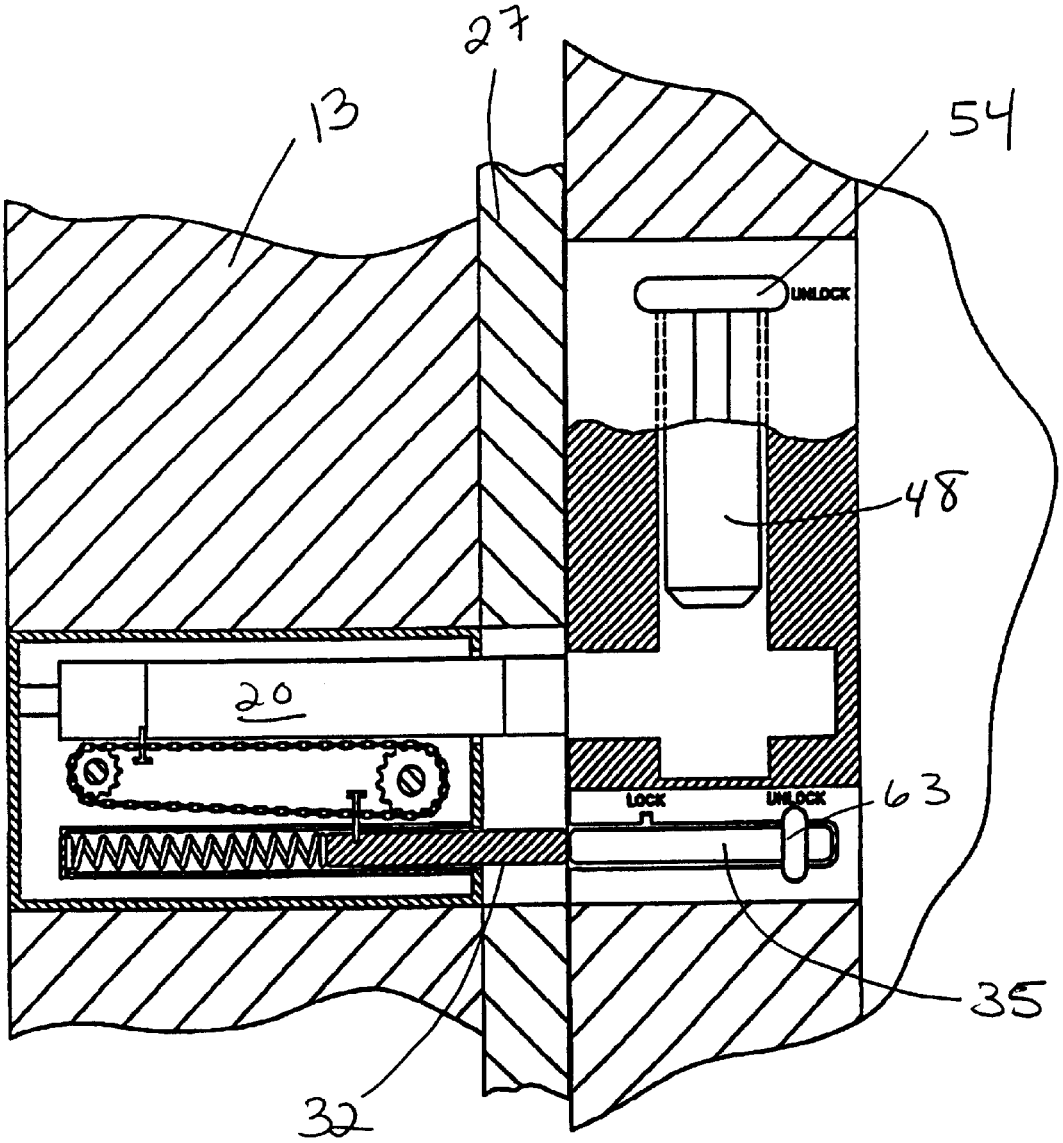
FIG. 11 is a partial cross-sectional view of the dead bolt assembly in an unlocked position.

Referring now to FIG. 7, to move the dead bolt 20 between the locked and unlocked positions in an automatic manner, an actuator 32 is provided which may be normally biased in an outwardly extended position. In this position, the actuator may preferably be flush with, or extend slightly beyond the thickness of the doorjamb 27, as best shown in FIG. 11. The actuator 32 may be operatively connected to the dead bolt 20 by a drive assembly 34, the drive assembly being activated upon movement of the actuator from the outwardly extended position inwardly, within the housing 18, and against the biasing force. For example, a plunger 35 (FIG. 12) may be supported on the sliding door for engaging the actuator when the sliding door is closed, as described in greater detail below. In the present embodiment, the drive assembly 34 may be a chain driven gear mechanism including a chain 36 which engages a first gear 38 and a second gear 40, and a pair of pins 42, 44 which are operatively connected to both the actuator 32 and the dead bolt 20, respectively. A spring 46 may be utilized to bias the actuator in the outward position, and the pin 42 may be inserted through the chain 36 and secured within the actuator, while the pin 44 may be inserted through the chain 36, in contact with the dead bolt 20. Alternately, other types of drive assemblies may be utilized to operatively connect the actuator to the dead bolt 20, as would be known to those of skill in the art. As the actuator moves from its normally outwardly biased position inward, it activates the drive assembly, causing the dead bolt 20 to move in the opposite, outward direction, so as to extend from within housing 18. As the dead bolt 20 moves outwardly from within the wall stud 13, it enters the door mounted dead bolt assembly 16 through opening 47, until it is in the locking position. Once moved into the locking position, the wall supported dead bolt 20 is ready to be engaged by the door mounted dead bolt lock 16 in order to secure the door closed.

Figure 9:
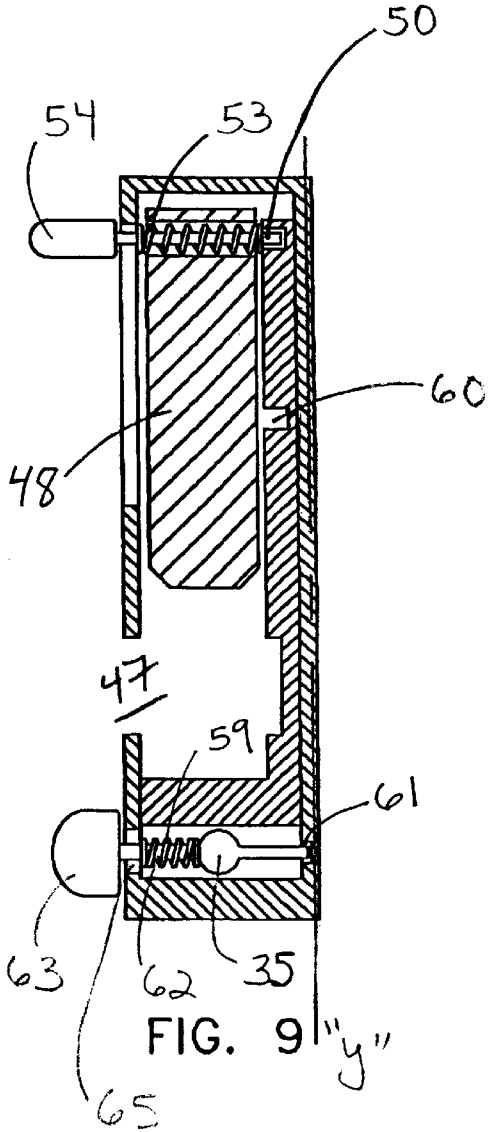
FIG. 9 is a cross-sectional side view of the wall mounted dead bolt of FIG. 8.
Figure 8:
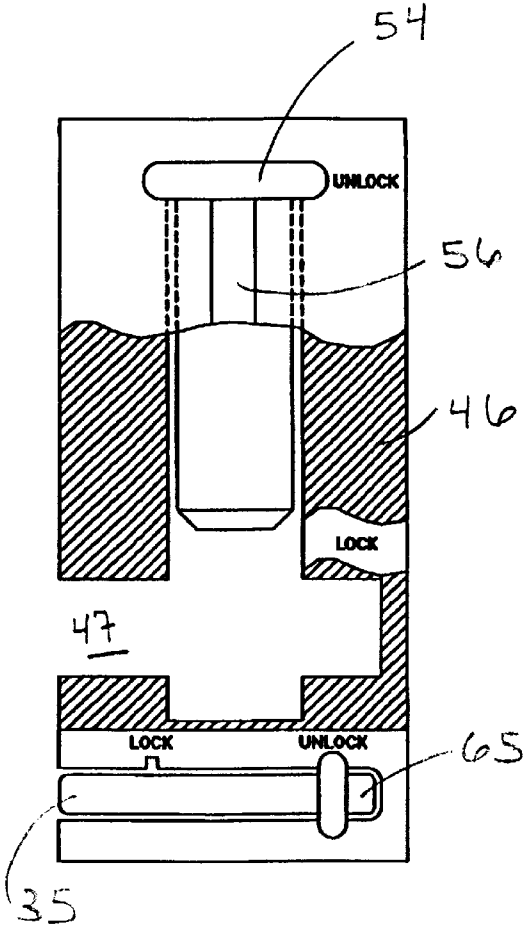
FIG. 8 is a front view of the door mounted dead bolt partially cut away.
Figure 10:
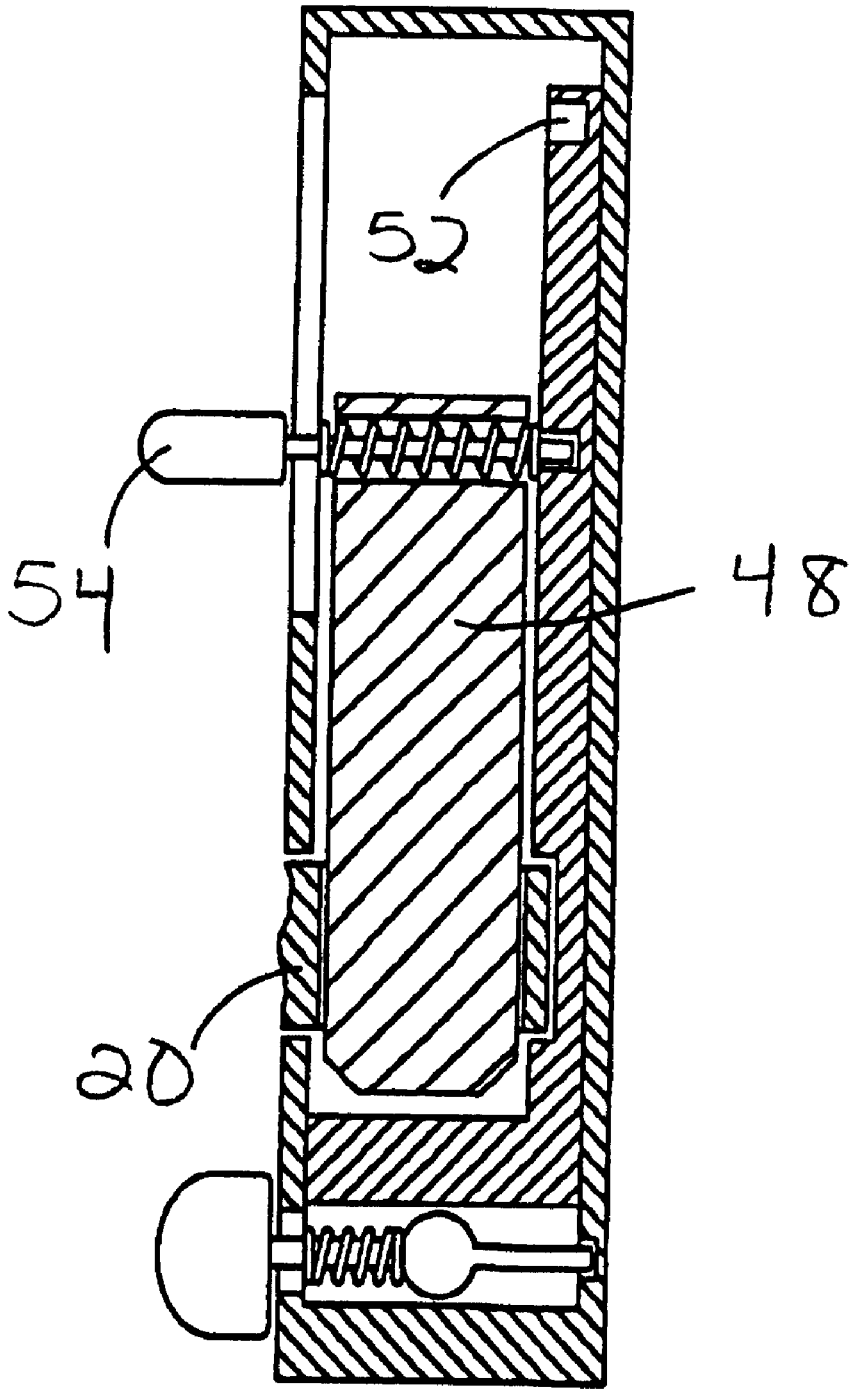
FIG. 10 is a cross-sectional side view of the dead bolt assembly in the locked position.

Door mounted dead bolt lock 16 preferably includes a housing 46 mountable within sliding door 12 for supporting dead bolt 48 therein. Dead bolt 48 is preferably movable along an axis "y", which is substantially perpendicular to the axis "x" along which the dead bolt 20 is moved. Referring now to FIGS. 8–10, the bolt 48 is preferably supported within the housing by pin 50, such that the bolt is normally in an unlocked position, until moved into the locked position. In the present embodiment, pin 50 is biased into engagement with a first cavity 52 formed in housing 46 in the unlocked position. In order to move the bolt 48 into the locked position, the biasing force must be overcome in order to remove the pin from within the first cavity 52. In the present embodiment, a spring 53 is positioned around the pin and is utilized to bias the pin, although other devices may be utilized, as would be known to those of skill in the art. For example, magnetic attraction could be utilized, as well as any of a number of devices, as would be known to those of skill in the art. A handle 54 may be connected to pin 50 which extends from within an opening 56 formed in the housing, such that a user can grasp the handle 54 and pull the pin to overcome the biasing force and remove the pin from engagement with cavity 52. Once removed from engagement with cavity 52, the bolt 48 is free to move into the locked position, in engagement with aperture 26 of dead bolt 20.

Housing 46 further includes a second cavity 60 for engagement with pin 50 in the locked position and opening 47 for receiving dead bolt 20 in the locked position. The housing may also support plunger 35 which is provided to activate actuator 32. The plunger 35 is preferably normally biased in the unlocked position, and may also preferably be supported within the housing by a second pin 62 which may be biased into engagement with a third cavity 61 formed in the housing 46. In order to move the plunger 35 into the locked position, the biasing force must be overcome in order to remove the pin from within the cavity 61. In the present embodiment, a spring 59 is positioned around the pin and is utilized to bias the pin, although other devices may be utilized, as would be known to those of skill in the art. A handle 63 may be connected to the pin 62 and extend from within an opening 65 formed in the housing, such that a user can grasp the handle 63 and pull the pin to overcome the biasing force to remove the pin from engagement with cavity 61. Once removed from engagement with cavity 61, the plunger 35 may be moved into contact with actuator 32, until the plunger reaches its locked position where the pin 62 engages a cavity (not shown) aligned with the locked position of the plunger, as described above with respect to dead bolt 48.

Door mounted dead bolt lock 16 preferably initiates the locking sequence upon activation of plunger 35, and completes the locking sequence upon movement of dead bolt 48 into engagement with aperture 26. As such, the outer surface of the housing adjacent both the plunger 35 and dead bolt 48 preferably includes indicia to indicate whether or not the dead bolt locking assembly is locked or unlocked. It will be readily apparent that both the plunger and the dead bolt need to be in the locked position in order for the locking assembly to lock the sliding door in the closed position. For convenience, it is possible to leave the plunger in the locked position (FIG. 15), so that the wall mounted dead bolt automatically moves within the door mounted dead bolt assembly when the door is closed, and only the door mounted dead bolt need to be moved in order to lock the sliding door shut.

Use of the dead bolt lock assembly will now be described with continued reference to FIGS. 1–15.

In use, the housing 18 of the wall mountable dead bolt lock 14 is inserted within an appropriately sized opening 64 formed in wall stud 13, for example a 2'×4'. The face plate 30 may then be secured to both the housing 18 and the wall stud 13. The faceplate 30 may include a number of openings 66 (FIG. 3) for receiving one or more fasteners to secure the faceplate, and hence housing, to wall stud 13. In the present embodiment, the openings 66 may have an oval shape so as to allow the faceplate to be adjusted vertically in order to properly align the wall mounted dead bolt 20 with the opening 47 in the housing of the door mounted dead bolt. An opening 68 may also be provided in the faceplate 30 for receiving a set screw (not shown) to further secure the faceplate and housing. Once the wall mounted dead bolt lock is positioned within wall stud 13, the door or window jamb 27 can be installed, as is conventional. The jamb 27 will include an opening to allow the dead bolt 20 and the actuator 32 to pass there through. The actuator 32 and/or the dead bolt 20 may be flush with the door jamb 27, or may extend slightly beyond the thickness of the doorjamb 27. The door mounted dead bolt lock 16 may be factory installed, such that the housing 46 is supported within the frame 70 of the sliding door, and so that the side of the housing having openings 56 and 65 lays substantially flush with the inside edge 72 of the sliding door frame, while the opening 47 is disposed along the engagement edge 74 of the frame. The wall mounted dead bolt assembly 14 and the door mounted dead bolt assembly 16 may then be further adjusted so that they are properly aligned when the sliding door is closed. In other words, the plunger 35 should be aligned with the actuator 32, the dead bolt 20 should be aligned with opening 47, and the dead bolt 48 should be properly positioned to be received within opening 26 in the locked position.

Figure 12:
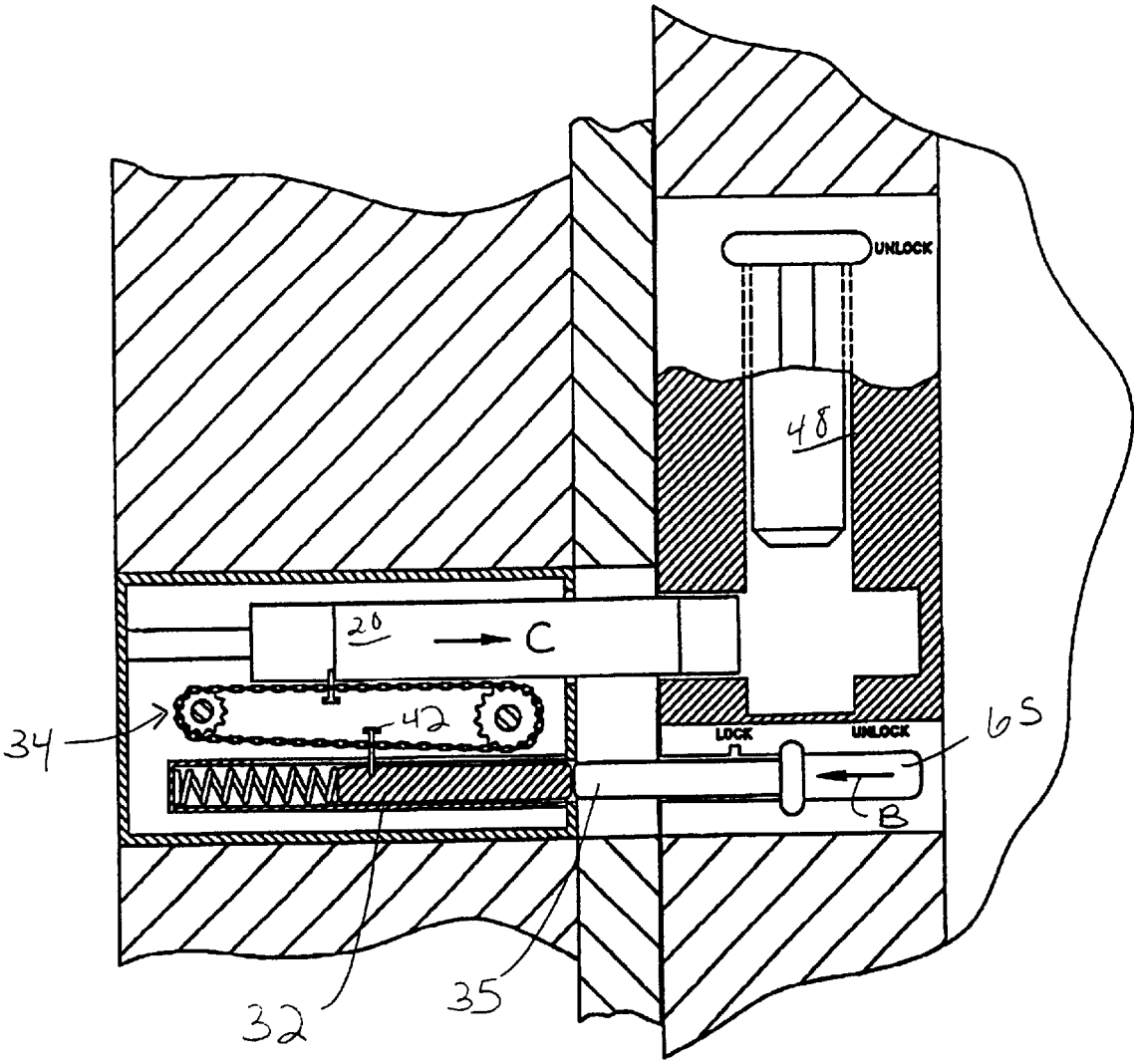
FIG. 12 is a partial cross-sectional view of the dead bolt assembly moving from the unlocked position to a locked position.
Figure 13:
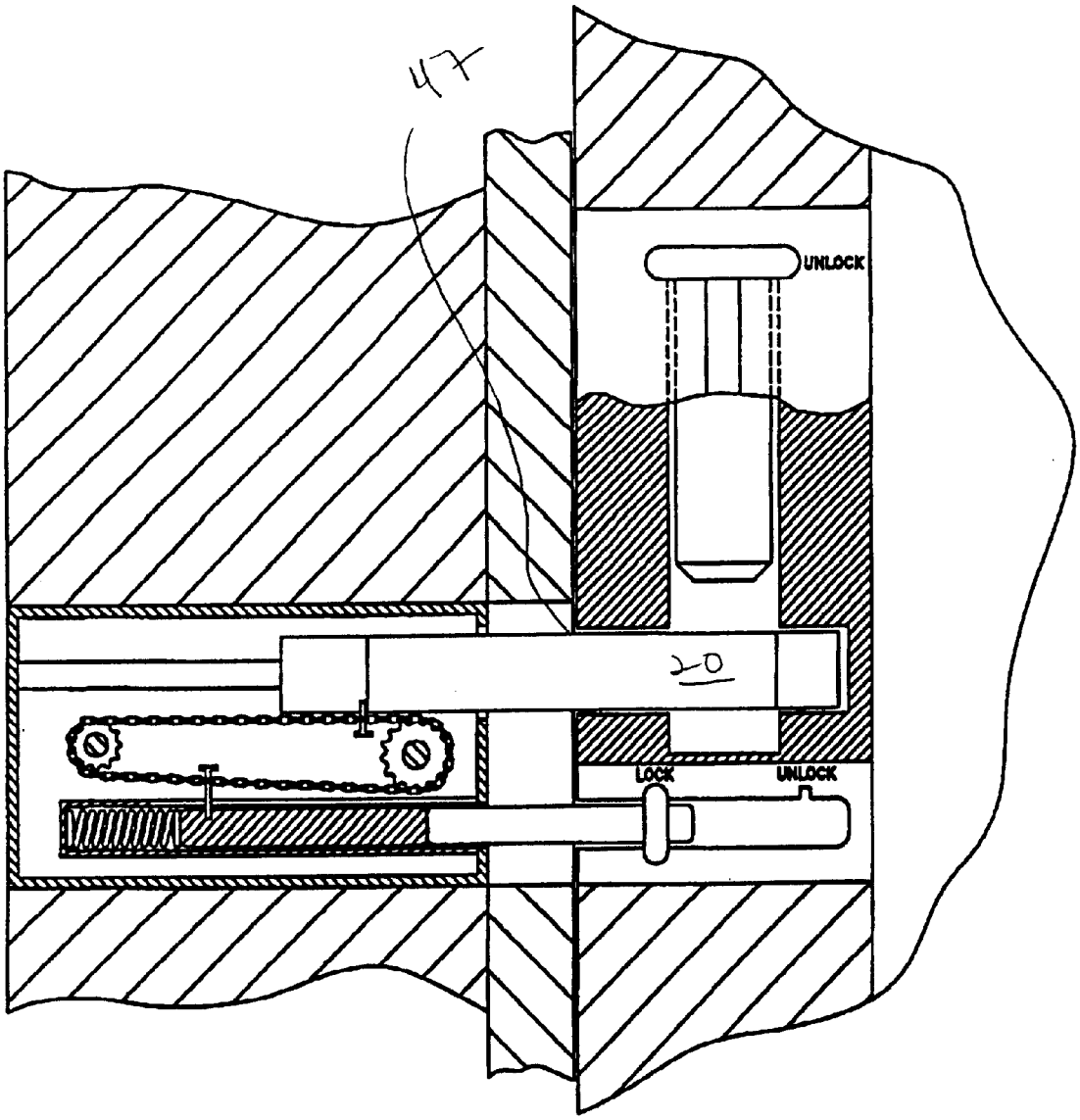
FIG. 13 is a partial cross-sectional view of the dead bolt assembly with the wall mounted dead bolt in the locked position and the door mounted dead bolt in the unlocked position.
Figure 15:
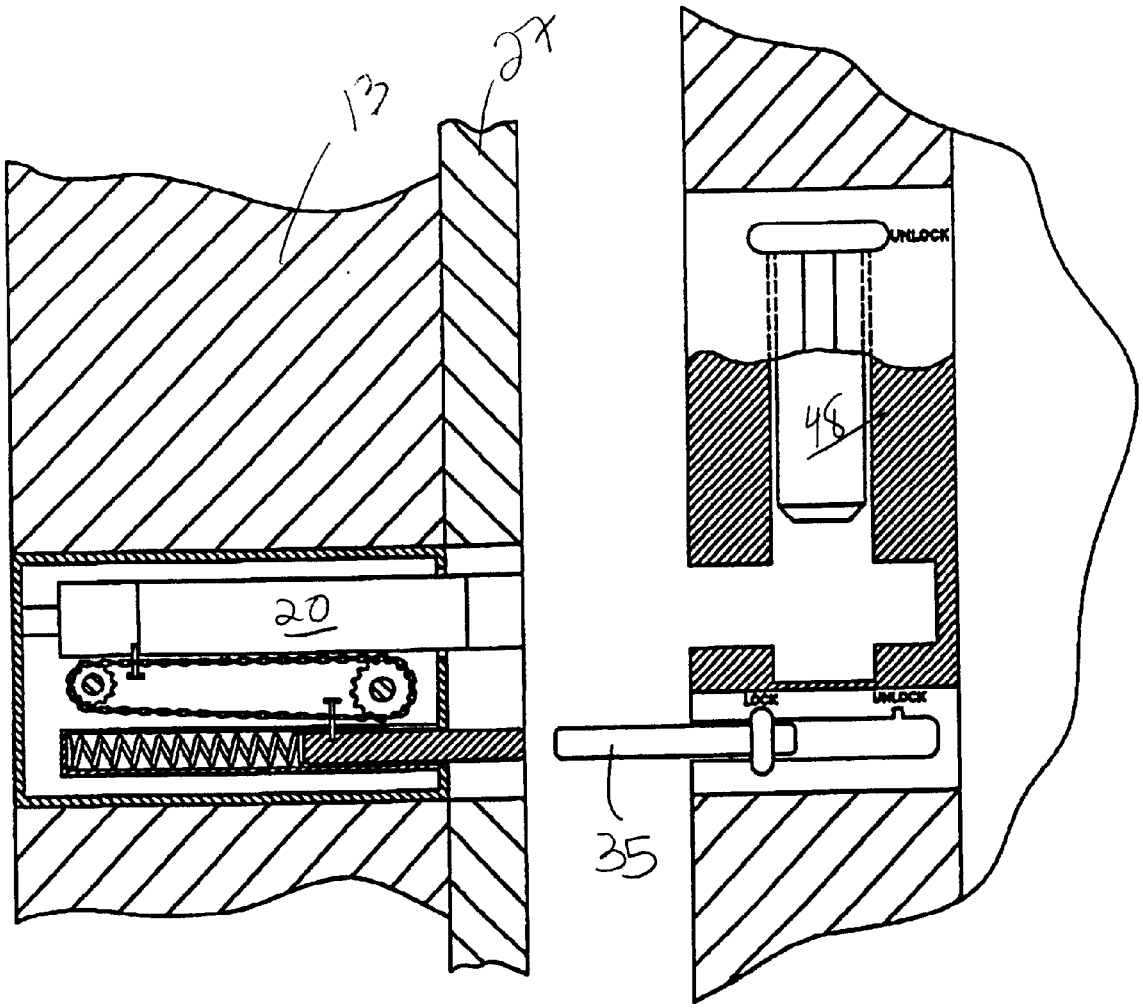
FIG. 15 is a partial cross-sectional view of the dead bolt assembly with a plunger in the extended position prior to the sliding door being closed.

Once properly installed, the dead bolt assembly 10 is ready for use. The user slides the door 12 closed such that the engagement edge 74 of door frame 70 abuts the door jamb 27. The user then pulls on the handle 63 to overcome the biasing force and slides the handle toward the door jamb 27 to move the plunger 35 into engagement with the actuator 32. As the plunger 35 engages the actuator 32, it overcomes the force of spring 42 to move the actuator 32 inwardly, within housing 18 in the direction of arrow "B" (FIG. 12). As the actuator moves inwardly, it causes pin 42 to likewise move in the direction of arrow B which, in turn, moves chain 36 supported by gears 38 and 40. Movement of chain 36 causes movement of pin 44 which is in contact with the dead bolt 20. The dead bolt 20 is driven by the pin 44 in the direction of arrow "C", outwardly, from within housing 18 and through opening 47. The plunger is moved until it reaches the locked position where the pin 62 engages a cavity (not shown). In this position, the dead bolt 20 is fully received within housing 46 (FIG. 13) and is ready to receive dead bolt 48 there through. The dead bolt 48 is lowered by grasping handle 54 and pulling to overcome the biasing force of spring 53 in order to remove pin 50 from within cavity 52. The handle 54 is then slid downward, in the direction of arrow "D" until the tapered end of dead bolt 48 is received within aperture 26 to lock the door. To unlock the door, the process is reversed by first removing the dead bolt 48 from engagement with aperture 26 and by returning the plunger 35 to the unlocked position, thus returning the actuator 32 to its outwardly biased position, and the dead bolt 20 to within housing 18. Alternately, the dead bolt 48 can be removed from engagement with aperture 26, and the door can be opened, leaving the plunger in the locked position (FIG. 15). The actuator and dead bolt 20 will return to their unlocked position when the door is opened, since the plunger will no longer be in contact with the actuator 32. However, when the sliding door is again closed, the actuator will be immediately activated by the plunger.

Thus, it will be appreciated that the dead bolt lock assembly 10 provides a lock for a sliding door or window which is easy and effective to use, which can be readily installed and which appears attractive in its surroundings.

It will be understood that various modifications may be made to the embodiment disclosed herein. For example, although the dead bolt lock assembly is described as having an actuator for automatic locking, the actuator may be eliminated and the dead bolt assembly may be locked by manually moving the dead bolt 20. In addition, the dead bolts may have alternate shapes and sizes, may be made of any suitable material other than those described herein, and may be supported by other devices, such as a single guide rod or by magnetic attraction. Also, members which are described as unitary may be formed separately and joined together and members which are described as separate may be formed as a unitary member, where appropriate. Likewise, directions may be reversed and "pulling" may be replaced by "pushing", as would be known to those of skill in the art. Therefore, the above description should not be construed as limiting, but merely as exemplifications of a preferred embodiment. Those skilled in the art will envision other modifications within the scope, spirit and intent of the invention.

We claim:

1. The dead bolt lock assembly for use with a slidable door or window having at least one slidable panel, comprising:

a wall mountable dead bolt lock including a housing constructed and arranged to be installed within a wall stud;

a first dead bolt having a first end supported within the housing and adapted to move reciprocally into and out of the housing along a first axis and having a second end including an aperture formed therein;

a door mountable dead bolt lock including a housing-constructed and arranged to be installed within a frame of the slidable panels the housing including an opening constructed and arranged to receive the first dead bolt in a locked position and supporting a second dead bolt therein, the second dead bolt being movable between a first, unlocked position spaced from the first dead bolt and a second locked position in which the second dead bolt is at least partially received within the aperture of the first dead bolt;

an actuator operatively connected to the first dead bolt, wherein movement of the actuator in a first direction causes the first dead bolt to move in a second direction, opposite the first direction of the actuator; and wherein upon moving the second dead bolt into the aperture of the first dead bolt the sliding panel is secured in a closed position.

2. The dead bolt lock assembly of claim 1, wherein the actuator is operatively connected to the first dead bolt by a drive assembly.

3. The dead bolt lock assembly of claim 2, wherein the drive assembly comprises a chain driven gear mechanism including a chain constructed and arranged to engage a first gear and a second gear, and a pair of pins, one pin being operatively connected the actuator, and the other pin being operatively connected to the dead bolt.

4. The dead bolt lock assembly of claim 1, wherein the actuator is normally biased in an outwardly extended position, such that the actuator is approximately flush with a jamb of the sliding member.

5. The dead bolt lock assembly of claim 4, wherein the actuator is biased by a spring.

6. The dead bolt lock assembly of claim 1, further comprising a plunger supported on the sliding panel and constructed and arranged to engage the actuator so as to move the actuator in the first direction, within the housing of the wall mountable dead bolt lock.

7. The dead bolt lock assembly of claim 6, wherein the plunger is movable between an unlocked position and a locked position in which it engages the actuator.

8. The dead bolt lock assembly of claim 7, wherein the plunger is supported within the housing of the door mountable dead bolt by a pin and is normally biased in the unlocked position by a spring positioned about the plunger pin.

9. The dead bolt lock assembly of claim 8, further comprising a handle constructed and arranged to be grasped by a user and supported by one end of the plunger pin, such that a user can grasp the handle and pull the plunger pin to overcome the biasing force and move the plunger between the unlocked and locked positions.

10. A dead bolt lock assembly for use with a slidable door or window having at least one slidable panel comprising:

a wall mountable dead bolt lock including a housing constructed and arranged to be installed within a wall stud;

a first dead bolt having a first end supported within the housing on at least one guide rod, such that the first dead bolt is slidable upon the at least one rod in order to move the first dead bolt reciprocally into and out of the housing along a first axis, between the locked and unlocked positions, and having a second end including an aperture formed therein;

a door mountable dead bolt lock including a housing constructed and arranged to be installed within a frame of the slidable panel, the housing including an opening constructed and arranged to receive the first dead bolt in a locked position, and supporting a second dead bolt therein, the second dead bolt being movable between a first, unlocked position spaced from the first dead bolt and a second, locked position in which the second dead bolt is at least partially received within the aperture of the first dead bolt; and wherein upon moving the second dead bolt into the aperture of the first dead bolt the sliding panel is secured in a closed position.

11. The dead bolt lock assembly of claim 10, wherein the first dead bolt includes a cross piece having at least one aperture constructed and arranged to receive the at least one guide rod therein.

12. The dead bolt lock assembly of claim 11, wherein the first dead bolt lock further includes a locking piece having a first end supported on the cross piece so as to form a "T" shaped configuration, and extending from the cross piece a length sufficient to project from within the wall stud and engage the second dead bolt lock in the locked position.

13. A method of securely locking a slidable panel closed, comprising the steps of:

mounting a dead bolt lock including a housing within a wall stud, the wall mounted dead bolt lock including a first dead bolt having a first end supported within the housing and adapted to move reciprocally into and out of the housing along a first axis, and having a second end including an aperture formed therein;

providing a dead bolt lock including a housing within a frame of the slidable panel, such that an opening in the housing is positioned to receive the first dead bolt in a locked position, the door mounted dead bolt lock further including a second dead bolt supported therein, the second dead bolt being movable between a first, unlocked position spaced from the first dead bolt and a second, locked position in which the second dead bolt is received within the aperture of the first dead bolt;

wherein upon moving the second dead bolt into the aperture of the first dead bolt, the slidable panel is locked closed.

14. The method of claim 13, further comprising the step of providing an actuator operatively connected to the first dead bolt, and wherein movement of the actuator in a first direction causes the first dead bolt to move in a second direction, opposite the first direction of the actuator.

15. The method of claim 14, further comprising the step of providing a plunger supported on the sliding panel and constructed and arranged to engage the actuator so as to move the actuator in the first direction, within the housing of the wall mountable dead bolt lock.

16. The method of claim 15, further comprising the steps of moving the plunger into engagement with the actuator so as to move the actuator in the first direction, movement of the actuator causing the first dead bolt to move in the second direction from within the housing of the wall mounted dead bolt lock and into the housing of the slidable panel dead bolt lock, and moving the second dead bolt into engagement with the aperture of the first dead bolt so as to lock the slidable panel closed.

* * * * *